US008648886B2

(12) United States Patent
Baek

(10) Patent No.: US 8,648,886 B2
(45) Date of Patent: Feb. 11, 2014

(54) LIQUID CRYSTAL DISPLAY DEVICE AND DRIVING METHOD THEREOF

(75) Inventor: Heume Il Baek, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 318 days.

(21) Appl. No.: 12/849,716

(22) Filed: Aug. 3, 2010

(65) Prior Publication Data

US 2011/0032283 A1 Feb. 10, 2011

(30) Foreign Application Priority Data

Aug. 4, 2009 (KR) ..... 10-2009-0071632

(51) Int. Cl.
*G09G 5/10* (2006.01)

(52) U.S. Cl.
USPC ..... 345/690

(58) Field of Classification Search
USPC ..... 345/126, 102
See application file for complete search history.

(56) References Cited

U.S. PATENT DOCUMENTS

| | | | | |
|---|---|---|---|---|
| 7,106,294 | B2 * | 9/2006 | Kumamoto et al. | 345/102 |
| 7,924,254 | B2 * | 4/2011 | Hsu et al. | 345/89 |
| 2003/0197674 | A1 * | 10/2003 | Herrmann | 345/102 |
| 2004/0114396 | A1 * | 6/2004 | Kobayashi et al. | 362/561 |
| 2007/0152926 | A1 * | 7/2007 | Kwon | 345/82 |
| 2007/0182699 | A1 * | 8/2007 | Ha et al. | 345/102 |
| 2008/0094346 | A1 * | 4/2008 | De Greef | 345/102 |
| 2009/0201244 | A1 * | 8/2009 | Park et al. | 345/102 |
| 2011/0025592 | A1 * | 2/2011 | Botzas et al. | 345/102 |

* cited by examiner

*Primary Examiner* — Kent Chang
*Assistant Examiner* — Nathan Brittingham
(74) *Attorney, Agent, or Firm* — Birch, Stewart, Kolasch & Birch, LLP

(57) ABSTRACT

An LCD device and a driving method thereof are discussed. The LCD device can prevent a blended color within each block which is defined in an LCD panel. To this end, the LCD device divides an external image data into a plurality of block image data, generates first dimming signals opposite to red, green, and blue data with each block image data, and provides a second dimming signal opposite to a brightness data with each block image data. Also, the LCD device calculates a difference value between maximum and minimum grayscale values by analyzing histograms for the red, green, and compares the calculated difference value with a reference difference value. Furthermore, the LCD device allows one of the first and second dimming signals to be selected according to the dimming mode control signal.

11 Claims, 6 Drawing Sheets

LIQUID CRYSTAL DISPLAY DEVICE AND DRIVING METHOD THEREOF

CROSS-REFERENCE TO RELATED APPLICATION

This application claims priority under 35 U.S.C. 119 to Korean Patent Application No. 10-2009-0071632, filed on Aug. 4, 2009 in Republic of Korea, which is hereby incorporated by reference in its entirety.

BACKGROUND

1. Field of the Disclosure

This disclosure relates to a liquid crystal display (LCD) device, and more particularly to an LCD device adapted to prevent a blended color within each block, which is defined in a screen.

2. Description of the Related Art

In general, flat panel display devices are classified into a luminous type and a non-luminous type. The luminous type display devices include cathode ray tubes (CRTs), plasma display panels (PDPs), field emission display (FED) devices, and others. The non-luminous type display devices include LCD devices.

The LCD device has features such as light weight, less power consumption, and so on. However, the LCD device can not implement its own images due to its non-luminous property. In other words, the LCD device must use incident light from the exterior, in order to display images. As such, the image displayed on the LCD device is not visible in dark circumstances. To address this matter, the LCD device is configured to include a backlight unit disposed on it.

The backlight unit has widely employed a linear light source such as a cold cathode fluorescent lamp (CCFL), an external electrode fluorescent lamp, or others. Such fluorescent lamps have disadvantages such as large size, large power consumption, critical brightness, and others.

Due to this, light emission diodes (LEDs) corresponding to a spotted light source are being used in the backlight unit, instead of the fluorescent lamps. The LEDs can not primarily provide enough brightness to be used in the backlight unit. Also, a manufacturing cost of the primary LEDs is very high.

However, LEDs provided with sufficiently high brightness, a low manufacturing cost, and less power consumption have been developed recently. In order to generate a two-dimensional light, white LEDs can be used for forming an array, or red, green, and blue LEDs can be appropriately used for forming an array. The backlight unit employing such LEDs can be configured in a variety of LED arrays, in order to provide light of a desired shape. As such, the performance of the backlight unit depends upon the LED driving method.

Actually, the backlight unit allows the LEDs to be divisionally arranged in blocks into which an LCD panel of the LCD device is defined, and independently drives the LED blocks, in order to independently display blocked images (hereinafter, block images) which are each opposite to the divided blocks. In this case, each of the block image data can include pure chromatic color components with a high chroma level and non-chromatic color components. Due to this, a blended color can be caused in a boundary between the chromatic and non-chromatic color domains within the block image.

More particularly, as the number of blocks defined on the LCD panel must be limited, the chromatic and non-chromatic color domains are often generated to mix each other in only a specific block of the LCD panel. As such, the blended color (or, a deteriorated hue) often appears on only the specific block of the LCD panel. This color mixing phenomenon within each block image is generated in the blocks when the backlight unit employs not only the white LEDs but also the red, green, and blue LEDs.

BRIEF SUMMARY

Accordingly, the present embodiments are directed to an LCD device that substantially obviates one or more of problems due to the limitations and disadvantages of the related art.

An object of the present disclosure is to provide an LCD device that is adapted to prevent a blended color within each block, which is defined in a screen.

Additional features and advantages of the embodiments will be set forth in the description which follows, and in part will be apparent from the description, or may be learned by practice of the embodiments. The advantages of the embodiments will be realized and attained by the structure particularly pointed out in the written description and claims hereof as well as the appended drawings.

According to one general aspect of the present embodiment, an LCD device includes: a liquid crystal display panel configured to include a plurality of liquid crystal cell formed on regions which are defined by a plurality of gate lines and a plurality of data lines; a backlight unit configured to irradiate light on the liquid crystal display panel using a plurality of light emission diode arrays each with a plurality of light emission diodes; a first dimming signal generator configured to divide an external image data into a plurality of block image data and to generate first dimming signals opposite to red, green, and blue data with each block image data; a second dimming signal generator configured to generate a second dimming signal opposite to a brightness data with each block image data; a dimming mode controller configured to calculate a difference value between maximum and minimum grayscale values by analyzing histograms for the red, green, and blue data with each block data, to derive a dimming mode control signal from the difference value; a selector configured to select one of the first and second dimming signals in accordance with the dimming mode control signal from the dimming mode controller; and a light emission diode driver configured to drive the plurality of light emission diodes with each of the plural light emission diode arrays which are opposite a plural blocks.

LCD device driving methods according to another aspects of the present embodiment can be applied to an LCD device which includes a liquid crystal display panel configured to include a plurality of liquid crystal cell formed on regions which are defined by a plurality of gate lines and a plurality of data lines, and a backlight unit configured to irradiate light on the liquid crystal display panel using a plurality of light emission diode arrays each with a plurality of light emission diodes.

A method of driving the LCD device including: dividing an external image data into a plurality of block image data and generating first dimming signals opposite to red, green, and blue data with each block image data; generating a second dimming signal opposite to a brightness data with each block image data; calculating a difference value between maximum and minimum grayscale values by analyzing histograms for the red, green, and blue data with each block data, deriving a gain value from the difference value, and generating a dimming mode control signal with one of different logic levels by comparing the gain value with a reference gain value; selecting one of the first and second dimming signals according to the dimming mode control signal; and generating driving voltages necessary to drive the plurality of light emission diodes with each of the plural light emission diode arrays, which are opposite a plural blocks, according to the selected dimming signal.

Another method of driving the liquid crystal display device includes: dividing an external image data into a plurality of block image data and generating first dimming signals opposite to red, green, and blue data with each block image data; generating a second dimming signal opposite to a brightness data with each block image data; calculating a difference value between maximum and minimum grayscale values by analyzing histograms for the red, green, and generating a dimming mode control signal with one of different logic levels by comparing the gain value with a reference difference value; selecting one of the first and second dimming signals according to the dimming mode control signal; and generating driving voltages necessary to drive the plurality of light emission diodes with each of the plural light emission diode arrays, which are opposite a plural blocks, according to the selected dimming signal.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims. Nothing in this section should be taken as a limitation on those claims. Further aspects and advantages are discussed below in conjunction with the embodiments. It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the embodiments and are incorporated in and constitute a part of this application, illustrate embodiment(s) of the invention and together with the description serve to explain the disclosure. In the drawings.

DETAILED DESCRIPTION

Figure 1:
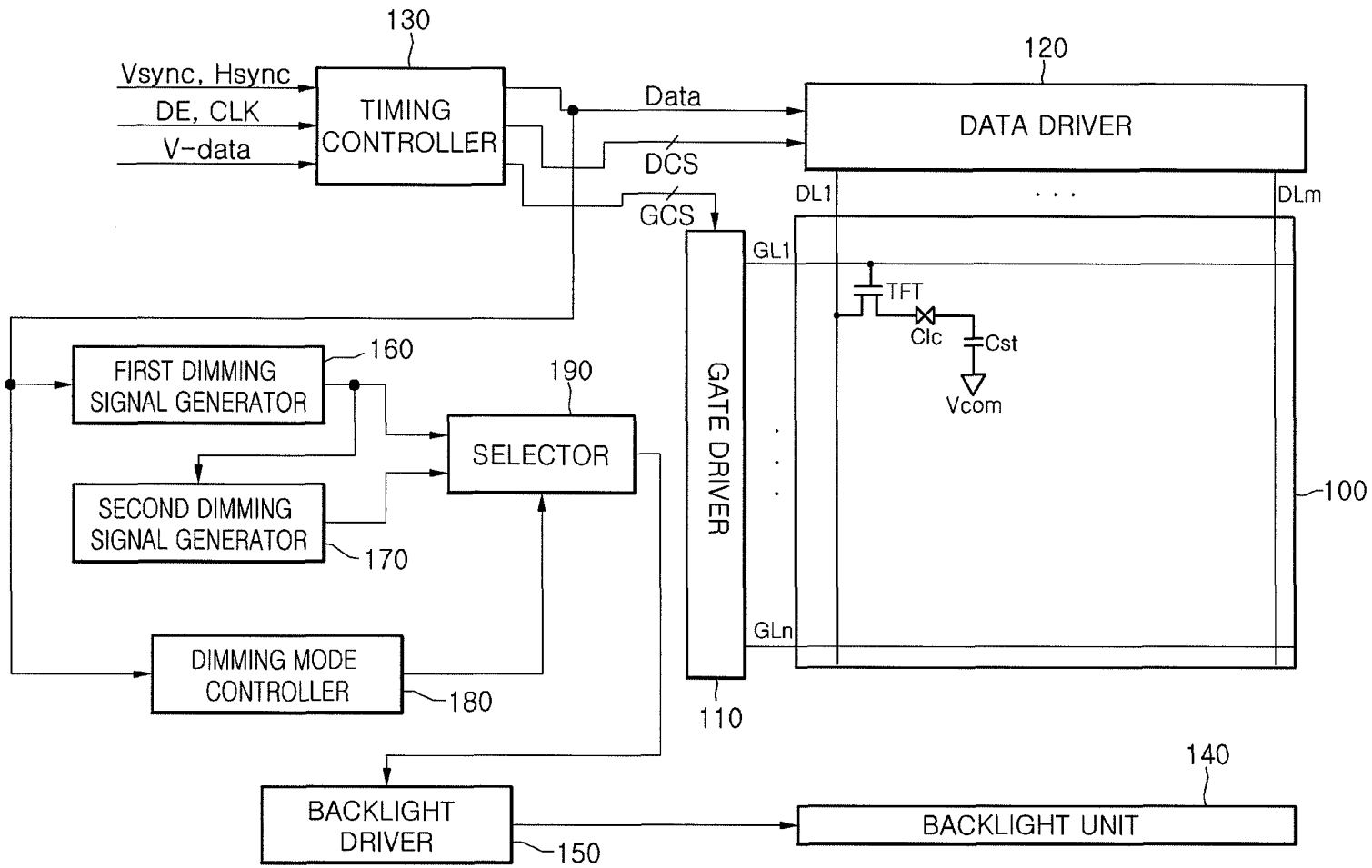
FIG. 1 is a block diagram showing an LCD device according to an embodiment of the present disclosure.

Reference will now be made in detail to the embodiments of the present invention, examples of which are illustrated in the accompanying drawings. These embodiments introduced hereinafter are provided as examples in order to convey their spirits to the ordinary skilled person in the art. Therefore, these embodiments might be embodied in a different shape, so are not limited to these embodiments described here. Also, the size and thickness of the device might be expressed to be exaggerated for the sake of convenience in the drawings. Wherever possible, the same reference numbers will be used throughout this disclosure including the drawings to refer to the same or like parts.

FIG. 1 is a block diagram showing an LCD device according to an embodiment of the present disclosure. Referring to FIG. 1, the LCD device according to an embodiment of the present disclosure includes: an LCD panel 100 configured to include a plurality of gate lines GL1~GLn, a plurality of data lines DL1~DLm, and a plurality of thin film transistors TFT; a gate driver 110 configured to apply scan signals to the gate lines GL1~GLn; a data driver 120 configured to apply data signals to the data lines DL1~DLm; a timing controller 130 configured to control the gate and data drivers 110 and 120; a backlight unit 140 configured to irradiate light to the LCD panel 100; and a backlight driver 150 configured to driver the backlight unit 140. The plurality of gate lines GL1~GLn and the plurality of data lines DL1~DLm are arranged to cross each other. The thin film transistors TFT are formed at the intersections of the gate lines GL1~GLn and data lines DL1~DLm and used to drive respective liquid crystal cells Clc.

The LCD device of the present embodiment further includes a first dimming signal generator 160 configured to generate first dimming signals opposite to red, green, and blue data within an input image data; a second dimming signal generator 170 configured to generate a second dimming signal opposite to a brightness data Y of the input image data; a dimming mode controller 180 configured to generate a dimming mode control signal; and a selector 190 configured to select one of the first and second dimming signals depending upon the dimming mode control signal and to apply the selected dimming signal to the backlight driver 150. In order to generate the dimming mode control signal, the dimming mode controller 180 analyzes histograms for the red, green, and blue data of the input image data and calculates a difference between maximum and minimum values using the analyzed histogram. Also, the dimming mode controller 180 derives a gain value from the calculated difference and compares the gain value with a reference gain value, and generates the mode control signal which has one of different logic levels in correspondence with the compared resultant.

The LCD panel 100 includes a liquid crystal layer (not shown) interposed two glass substrates. The plurality of gate lines GL1~GLn and the plurality of data lines DL1~DLm are formed to cross each other on a lower glass substrate of the two substrate. The thin film transistor TFT formed at each intersection of the gate and data lines GL1~GLn and DL1~DLm responds to a scan signal on a respective gate line GL and applies a data signal on a respective data line DL to the respective liquid crystal cell Clc. To this end, each of the thin film transistors TFT includes a gate electrode connected to the respective gate line GL, a source electrode connected to the respective data line DL, and a drain electrode connected to the respective liquid crystal cell Clc.

The lower glass substrate of the LCD panel 100 further includes a storage capacitor Cst used to maintain a voltage charged in the respective liquid crystal cell Clc. The storage capacitor Cst can be formed between the respective liquid crystal cell Clc and a previous gate line GLi-1. Alternatively, the storage capacitor Cst can be formed between the respective liquid crystal cell Clc and a separated common line.

An upper glass substrate of the LCD panel 100 includes red, green, and blue color filters formed opposite each pixel region of the lower glass substrate which is loaded with the thin film transistor. The upper glass substrate further includes a black matrix formed to rim each of the color filters, and a common electrode formed to cover all the color filters and black matrix. The black matrix functions to shield the gate lines GL1~GLn, data lines DL1~DLm, and thin film transistors TFT.

The gate driver 110 responds to gate control signals GCS from the timing controller 130 and applies the plurality of scan signals to the plurality of gate lines GL1~GLn, respectively. The plurality of scan signals allow the plurality of gate lines GL1~GLn to be sequentially enabled in the period of a single horizontal synchronous signal.

The data driver 120 also responds to data control signals DCS from the timing controller 130. Also, the data driver 120 generates a plurality of pixel data voltages and applies the pixel data voltages to the plurality of data lines DL1~DLm, whenever any one of the plural gate lines GL1~GLn is enabled.

The timing controller 130 derives the gate and data control signals GCS and DCS from synchronous signals Hsync and Vsync, a data enable signal DE, and a clock signal CLK which are received from an external system (not shown) such as the graphic module of a computer system, the image demodulation module of a television receiver. The gate control signals GCS are used for controlling the gate driver 110. The data control signals DCS are used for controlling the data driver 120. Also, the timing controller 130 rearranges image data received from the external system and applies the rearranged data "V-data" to the data driver 120.

Figure 2:
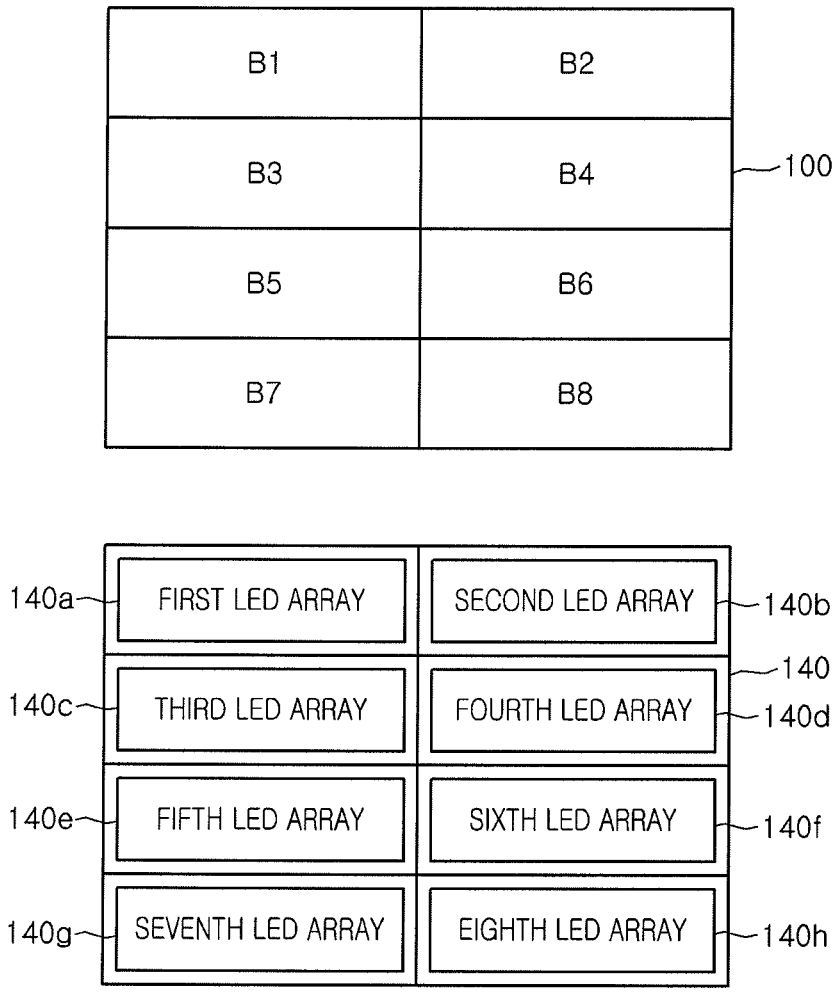
FIG. 2 is a schematic diagram showing the LCD panel and the backlight unit which are shown in FIG. 1.

Moreover, the timing controller 130 defines the LCD panel 100 into a plurality of blocks and forces one frame of pixel data to be rearranged distinguishably in blocks. A plurality of pixel data with each block image is opposite the plurality of pixels included in the respective block of the LCD panel 100, respectively. The image data rearranged in blocks is applied from the timing controller 130 to the first dimming signal generator 160 and the dimming mode controller 180. For example, the timing controller 130 can divide the LCD panel 100 into eight blocks B1~B8, as shown in FIG. 2. In this case, one frame of pixel data is rearranged distinguishably into eight block images.

The backlight unit 140 disposed on the rare surface of the LCD panel 100 includes first through eighth LED arrays 140*a* through 140*h* each opposite to the first through eighth blocks of the LCD panel 100. Each of the first through eighth LED arrays 140*a* through 140*h* includes a plurality of LEDs which are arranged in the first fixed number of rows and the second fixed number of columns.

The backlight driver 150 generates LED driving voltages necessary to drive the pluralities of LEDs included in the backlight unit 140. More specifically, the backlight driver 150 applies the LED driving voltages, which are used for independently driving the first through eighth LED arrays 140*a* through 140*h* each opposite to the first through eighth blocks B1~B8 of the LCD panel 100, to the backlight unit 140. The LED driving voltages from the LED driver 150 are generated to have a duty rate (or a duty cycle) in correspondence with one of the first and second dimming signals which is selected by the selector 190.

The first dimming signal generator 160 sequentially receives first through eighth block image data, which are each opposite the first through eighth blocks B1~B8 or the LCD panel 100, from the timing controller 130. The first dimming signal generator 160 calculates mean values for red, green, and blue pixel data within each block image data and generates first red, green, and blue dimming signals in correspondence with the red, green, and blue mean values. The first red, green, and blue dimming signals are used as a color dimming signal. Alternatively, the first dimming signal generator 160 can detect maximum values of red, green, and blue pixel data within each of the block image data. In this case, the first red, green, and blue dimming signals depend upon the red, green, and blue pixel data of the maximum values. The first dimming signals including red, green, and blue dimming signals are applied from the first dimming signal generator 160 to the selector 190.

The second dimming signal generator 170 receives the mean values of the red, green, and blue pixel data for each block image data from the first dimming signal generator 160. The second dimming signal generator 170 detects the highest mean value among the received mean values of the red, green, and blue pixel data and generates a second dimming signal in correspondence with the detected highest mean value, as a brightness dimming signal used to control the brightness Y of the block image. The second dimming signal generated in the second dimming signal generator 170 is applied to the selector 190.

Figure 3:
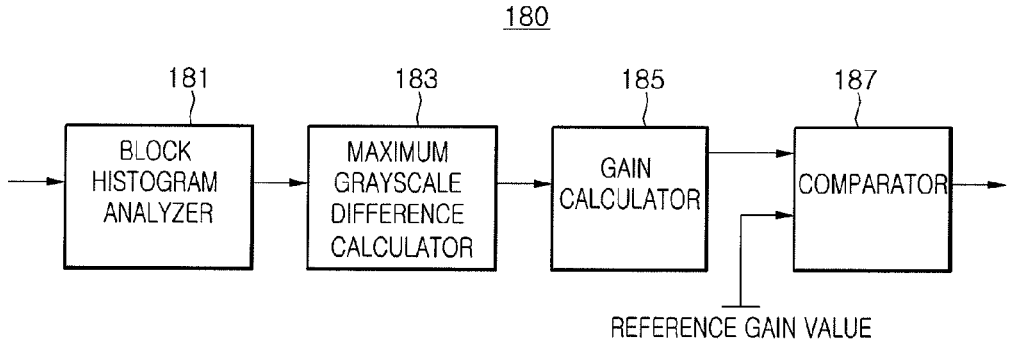
FIG. 3 is a detailed block diagram of the dimming signal controller shown in FIG. 1.

The dimming mode controller 180 includes a block histogram analyzer 181 configured to analyze a block histogram for each of the first through eighth block image data which are divided from the frame image data by the timing controller 130 and which are opposite the first through eighth blocks B1~B8 of the LCD panel 100, as shown in FIG. 3. The dimming mode controller 180 further includes a maximum grayscale difference calculator 183 configured to calculate the maximum and minimum grayscale values for each block image data using the block histograms analyzed by the block histogram analyzer 181 and to derive a maximum grayscale difference value for each block image data from the maximum and minimum grayscale values. The dimming mode controller 180 still further includes a gain calculator 185 configured to derive a gain value for each block image data from the maximum grayscale difference value provided by the maximum grayscale difference calculator 183, and a comparator 189 configured to compare the gain value applied from the gain calculator 185 with a reference gain value and to generate the dimming mode control signal which has one of the different logic levels in accordance with the compared resultant. The reference gain value is previously set to a fixed value suitable for the specifications of an LCD device.

The block histogram analyzer 181 sequentially receives the first through eighth block image data from the timing controller 130. The block histogram analyzer 181 distinguishably counts one block of red, green, and blue pixel data within each block image data in grayscale levels, in order to provide the block histogram for the red, green, and blue data, as upper graphic diagrams in FIGS. 4 and 5. The red, green, and blue pixel data are opposite the pixel regions within each of the divided blocks of the LCD panel 100. The block histograms for the red, green, and blue pixel data generated in the block histogram analyzer 181 are applied to the maximum grayscale difference calculator 183.

Figure 4:
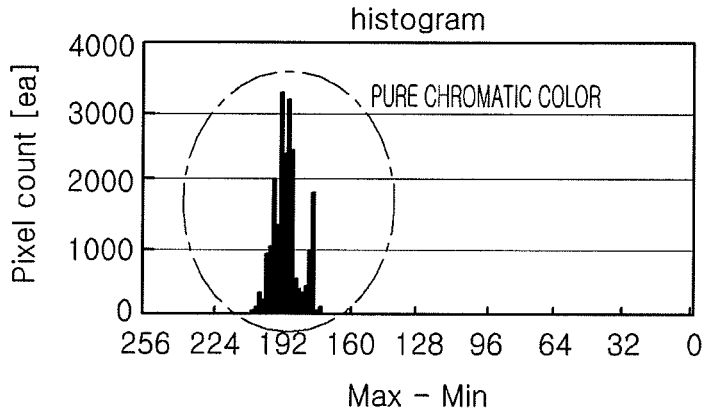
FIG. 4 is a histogram showing the number of pixel data accumulated from the pixel data of most significant grayscale level to the pixel data of least significant grayscale level within a block image data when only pure chromatic color components with high chroma level are included in a block image.
Figure 4:
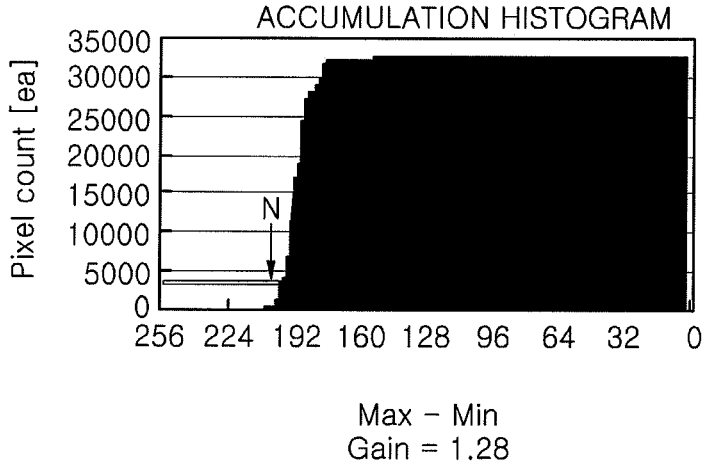
Figure 5:
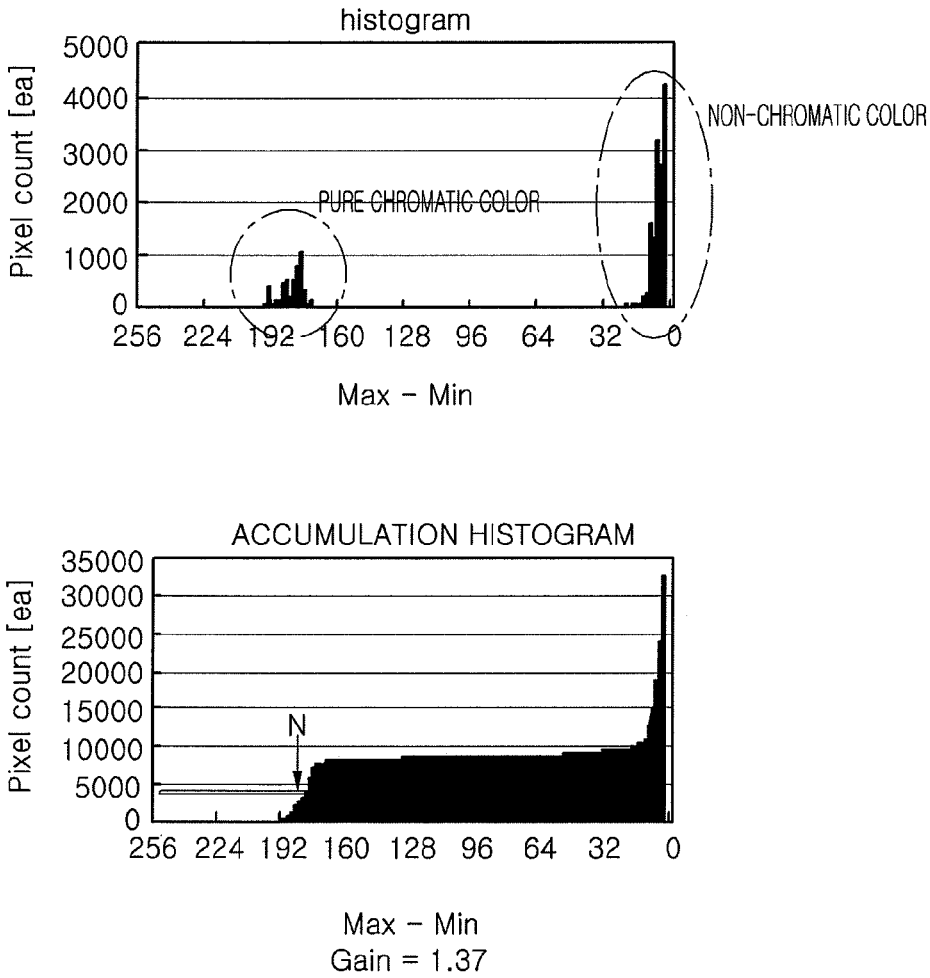
FIG. 5 is a histogram showing the number of pixel data accumulated from the pixel data of most significant grayscale level to the pixel data of least significant grayscale level within a block image data when pure chromatic color components with high chroma level and non-chromatic color components are included together in a block image.

In addition, the block histogram analyzer 181 can provide block accumulation histograms for the red, green, and blue pixel data within each block image data, as lower graphic diagrams in FIGS. 4 and 5. To this end, the block histogram analyzer 181 distinguishably accumulates one block of red, green, and blue pixel data within each block image data, from the pixel data of the most grayscale level to the pixel data of the least significant level.

The maximum grayscale difference calculator 183 derives the maximum and minimum grayscale values from the block histograms for the red, green, and blue data. Also, the maximum grayscale difference calculator 183 calculates difference between the maximum and minimum grayscale values, in order to obtain the maximum grayscale difference value. The maximum grayscale difference value is applied to the gain calculator 185.

If a block image data includes only pure chromatic color components with high chroma levels, one block of pixel data are converged to a high grayscale range of near 192, as shown in an upper histogram of FIG. 4. As such, the maximum grayscale difference value for the block image data becomes lower. Also, the accumulated number for one block of pixel data has high values in almost the entire grayscale range, as shown in a lower histogram of FIG. 4.

On the contrary, when a block image data includes pure chromatic color components with high chroma levels and non-chromatic color components with low chroma levels, one block of pixel data are distributed to a high grayscale range of near 192 and a low grayscale range of near 0, as shown in an upper histogram of FIG. 5. In accordance therewith, the maximum grayscale difference value for the block image data becomes higher. Also, the accumulated number for one block of pixel data has low values in almost the entire grayscale range, as shown in a lower histogram of FIG. 5.

The gain calculator 185 is configured to calculate the gain value based on the maximum grayscale difference value. To this end, the gain calculator 185 compares the maximum grayscale difference value with a reference grayscale difference value (not shown). If the maximum grayscale difference value is the reference grayscale difference value or less, the gain calculator 185 sets the gain value to a maximum value (for example, "2"). On the contrary, when the maximum grayscale difference value is larger than the reference grayscale difference value, the gain calculator 185 calculates the gain value using the block accumulation histogram from the block histogram analyzer 181.

More specifically, the gain calculator 185 calculates the gain value using an equation 1 as follow. The gain value represents a ratio of chromatic color components with respect to the entire color component of one block image data when the pure chromatic and non-chromatic color components are included in one block image data.

$$\text{Gain} = \frac{255}{1+N} \qquad \text{[Equation 1]}$$

In the above equation 1, a parameter "N" means a grayscale value for a pixel data which is accumulated at the same as a reference accumulation value when one block of pixel data are sequentially accumulated from the pixel data of the most significant grayscale level to the pixel data of the least significant grayscale level (in case of 8 bit data capable of having a set of 255 grayscale levels, from 255 to 0), as shown in the lower block histograms of FIGS. 4 and 5. The reference accumulation value is set to a pixel data number corresponding to a range of 1~5% of total pixel data included in each of the block image data, or to a pixel data number not affecting the display of image.

The gain calculator 185 uses the block accumulation histograms for the red, green, and blue pixel data provided by the block histogram analyzer 181 and obtains the parameter "N" of a degree not affecting the display of image. Thereafter, the gain calculator 185 calculates the gain value from the equation 1 using the parameter "N". The gain value has an effective range of about 1~2 and depends upon the parameter "N".

The comparator 187 compares the gain value calculated in the gain calculator 185 with the reference gain value which is previously established according the specifications of an LCD device. Also, the comparator 187 generates the dimming mode control signal which has one of different logic levels according to the compared resultant. If the gain value calculated in the gain calculator 185 is the reference gain value or less, the comparator 187 generates the mode control signal of a high logic level. On the contrary, when the calculated gain value becomes larger than the reference gain value, the comparator 187 generates the mode control signal of a low logic level. The mode control signal generated in the comparator 187 is applied to the selector 190 as shown in FIG. 1.

The reference gain value is set to determine the switch between color (red, green, and blue) or brightness dimming modes. For example, the reference gain value can be set to a value of 1.3.

The dimming mode control signal of the low logic level means that the proportion of the non-chromatic color component within one block image data is large enough to affect the display of the block image when the non-chromatic color component and the pure chromatic color component with high chroma level are included in one block image data. On the other hand, the dimming mode control signal of the high logic level represents the fact that the proportion of the non-chromatic color components within one block image data has a small value not affecting the display of the block image although the non-chromatic color components and the pure chromatic color components with high chroma level are included in one block image data.

The selector 190 responds to the dimming mode control signal from the comparator 187 and selects either the first dimming signals from the first dimming signal generator 160 or the second dimming signal from the second dimming signal generator 170. The selected dimming signal is applied to the backlight driver 150 in FIG. 1. More specifically, if the dimming mode control signal of the low logic level is generated in the comparator 187, the selector 190 selects the second dimming signal and applies the selected signal to the backlight driver 150. On the contrary, when the dimming mode control signal of the high logic level is generated in the comparator 187, the selector 190 selects the first dimming signals and applies the selected signals to the backlight driver 150.

The backlight driver 150 generates the LED driving voltages with the duty rate (or the duty cycle) in correspondence with the selected dimming signal from the selector 190. The LED driving voltages generated in the backlight driver 150 is applied to the backlight unit 140 with the pluralities of LEDs shown in FIG. 1.

In this manner, when the non-chromatic color component is included in the block image data, the LCD device according to the present disclosure compares the proportion of the chromatic color component opposite to the entire color components with the reference value and enables the backlight unit 140 to be driven in one of the first dimming mode (i.e., the color dimming mode) and second dimming mode (i.e., the brightness dimming). Therefore, the LCD device can minimize the generation of blended colors unlike that of the related art.

Figure 6:
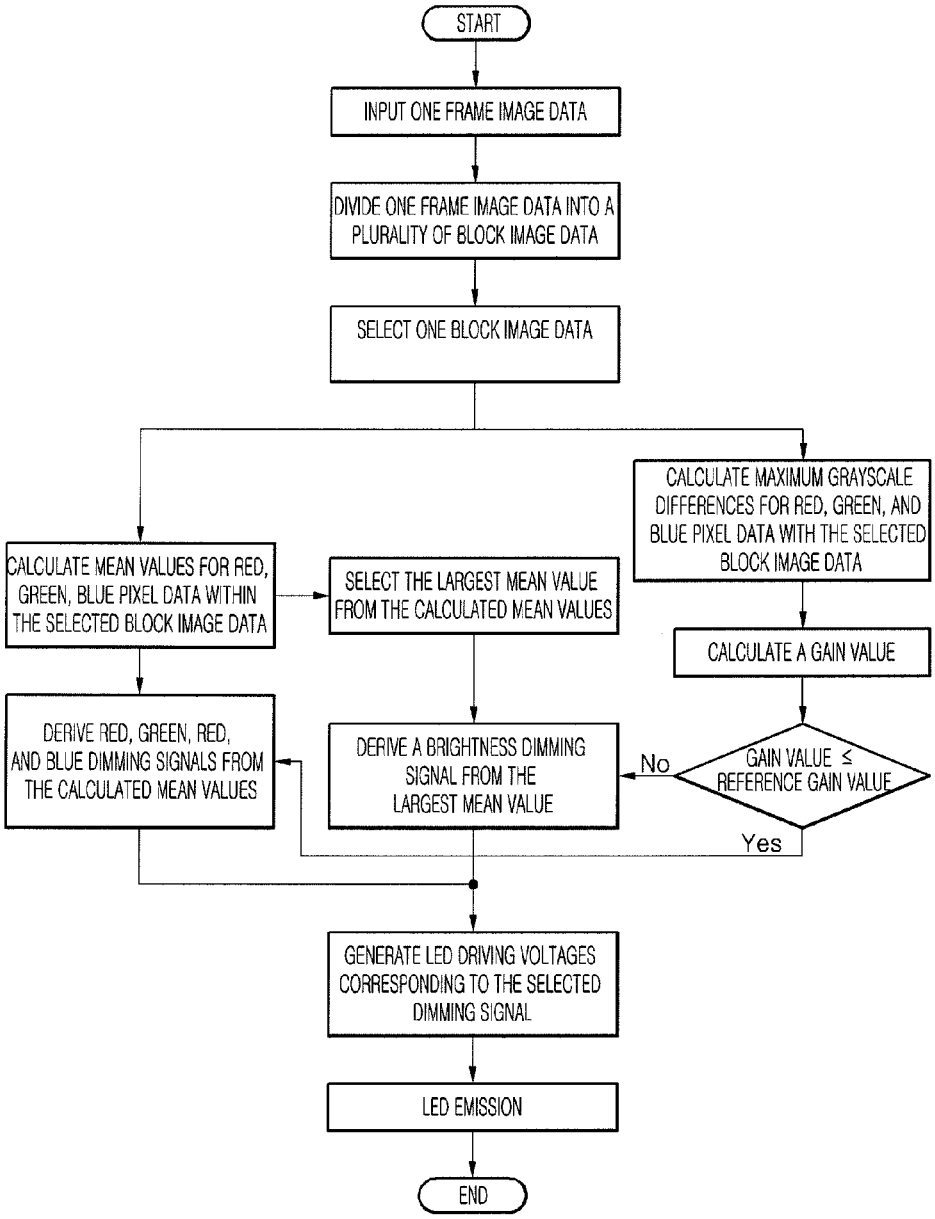
FIG. 6 is a flow chart illustrating a sequence selecting one of first and second dimming modes depending upon an image data which is input to an LCD device according to an embodiment of the present disclosure.

FIG. 6 is a flow chart illustrating a sequence selecting one of first and second dimming modes depending upon a frame image data which is input to an LCD device according to an embodiment of the present disclosure.

As shown in FIGS. 1 and 6, the LCD device according to the present disclosure inputs an image data of one frame and divides the input image data of one frame into a plurality of block image data. The LCD device selects one of the plural block image data, calculates mean values for each of red, green, and blue data within the selected block image data, and extracts the largest mean value among the red, green, and blue mean values. At the same time, the LCD device analyzes the histograms for the red, green, and blue data within the selected block image data and calculates a maximum grayscale difference value.

Subsequently, red, green, and blue dimming signals each corresponding to the mean values for the red, green, and blue data are generated. These red, green, and blue dimming signals are used to drive the backlight unit in a color dimming mode. At the same time, a brightness dimming signal corresponding to the largest mean value is also generated. In addition, a gain value is derived from the maximum grayscale difference value and compared with a reference gain value which is previously set according the specifications of an LCD device, thereby providing a dimming mode control signal which has one of different logic levels in correspondence with the compared resultant.

At this time, if the calculated gain value is the reference gain value or less, the red, green, and blue dimming signals are selected. On the contrary, when the calculated gain value becomes larger than the reference gain value, the brightness dimming signal is selected. Continuously, LED driving voltages in correspondence with either the red, green, and blue dimming signals or the brightness dimming signal are generated, so that LEDs within the backlight unit 140 are driven in one of the color and brightness dimming modes. Therefore, light emitted from the LEDs can be differently controlled according to the dimming modes.

In this way, when the non-chromatic color component is included in the block image data, the LCD device driving method of the present disclosure enables the LEDs within the respective block to be driven in one of the first dimming (i.e., the color dimming) and second dimming (i.e., the brightness dimming) modes according to the proportion of the chromatic color component opposite to the entire color components of the block image data. Therefore, the LCD device driving method can minimize the generation of blended colors unlike that of the related art.

In a different manner, the dimming mode controller 180 can be configured to remove the gain calculator 185. In this case, the comparator 187 receives a reference grayscale difference value instead of the reference gain value and compares the maximum grayscale difference value from the maximum grayscale difference calculator 183 with the reference grayscale difference value. If the maximum grayscale difference value is the reference grayscale difference value or less, the comparator 187 generates the dimming mode control signal of the low logic level. On the contrary, when the maximum grayscale difference value is larger than the reference grayscale difference value, the comparator 187 generates the dimming mode control signal of the high logic level. Such a dimming mode control signal is applied to the selector 190 shown in FIG. 1.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A liquid crystal display device comprising:

a liquid crystal display panel configured to include a plurality of liquid crystal cell formed on regions which are defined by a plurality of gate lines and a plurality of data lines;

a backlight unit configured to irradiate light on the liquid crystal display panel using a plurality of light emission diode arrays each with a plurality of light emission diodes;

a first dimming signal generator configured to divide an external image data into a plurality of block image data and to generate first dimming signals corresponding to red, green, and blue data with each block image data;

a second dimming signal generator configured to generate a second dimming signal corresponding to a brightness data with each block image data;

a dimming mode controller configured to calculate a difference value between maximum and minimum grayscale values by analyzing histograms for the red, green, and blue data with each block data, to derive a dimming mode control signal from the difference value;

a selector configured to select one of the first and second dimming signals in accordance with the dimming mode control signal from the dimming mode controller; and a light emission diode driver configured to drive the plurality of light emission diodes of each of the plural light emission diode arrays which correspond to a plural blocks, wherein the first dimming signal and the second dimming signal are applied to the selector, wherein the dimming mode control signal is generated from comparing a calculated gain value with a reference gain, wherein the gain value is calculated from the grayscale difference value, and wherein the gain value is calculated from equation 1:

$$\text{Gain} = \frac{255}{1+N},$$

in equation 1, the parameter N has a grayscale value for the red, green, and blue pixel data which is accumulated the same as a reference accumulation value when one block of the red, green, and blue pixel data is sequentially accumulated from the red, green, and blue pixel data of the most significant grayscale level to the red green, and blue pixel data of the least significant grayscale level, the reference accumulation value being set to the red, green, and blue pixel data number corresponding to a range of 1~5% of total red, green, and blue pixel data included in each of the block image data.

2. The liquid crystal display device claimed as claim 1, wherein the dimming mode controller includes:

a histogram analyzer configured to analyze the block histograms for the red, green, and blue data with each block image data;

a maximum grayscale difference calculator configured to derive the difference value between the maximum and minimum grayscale values from the block histograms provided by the block histogram analyzer;

a gain calculator configured to derive a gain value from the grayscale difference value; and a comparator configured to generate the dimming mode control signal with different logic levels by comparing the calculated gain value with a reference gain.

3. The liquid crystal display device claimed as claim 2, wherein the block histogram analyzer is further configured to provide a block accumulation histogram for the red, green, and blue pixel data within each block image data; and the gain calculator is further configured to set the gain value at a maximum value when the difference value is a reference difference value or less, and to derive the gain value from the block accumulation histogram provided by the block histogram analyzer.

4. The liquid crystal display device claimed as claim 2, wherein the reference gain value corresponds to a proportion of pure chromatic color components with respect to the total color components within the block image data when the pure chromatic components of high chroma levels with non-chromatic color components is included in the block image data, and has a range of 1~2.

5. The liquid crystal display device claimed as claim 1, wherein the first dimming signal generator is configured to calculate mean values for the red, green, and blue pixel data with each block image data and to derive the first dimming signals from the red, green, and blue mean values.

6. The liquid crystal display device claimed as claim 4, wherein the second dimming signal generator is configured to select the highest mean value from the red, green, and blue mean values generated in the first dimming signal generator, and to derive the second dimming signal from the selected highest mean value.

7. A method of driving a liquid crystal display device including: a liquid crystal display panel configured to include a plurality of liquid crystal cell formed on regions which are defined by a plurality of gate lines and a plurality of data lines; and a backlight unit configured to irradiate light on the liquid crystal display panel using a plurality of light emission diode arrays each with a plurality of light emission diodes, the method comprising:

dividing an external image data into a plurality of block image data and generating first dimming signals opposite to red, green, and blue data with each block image data;

generating a second dimming signal opposite to a brightness data with each block image data;

calculating a difference value between maximum and minimum grayscale values by analyzing histograms for the red, green, and blue data with each block data, deriving a gain value from the difference value, and generating a dimming mode control signal with one of different logic levels by comparing the gain value with a reference gain value;

selecting one of the first and second dimming signals according to the dimming mode control signal from a selector; and generating driving voltages necessary to drive the plurality of light emission diodes of each of the plural light emission diode arrays, which correspond to a plural blocks, according to the selected dimming signal, wherein the first dimming signal and the second dimming signal are applied to the selector, and wherein the gain value is calculated from equation 1:

$$\text{Gain} = \frac{255}{1+N},$$

in equation 1, the parameter N has a grayscale value for the red, green, and blue pixel data which is accumulated the same as a reference accumulation value when one block of the red, green, and blue pixel data is sequentially accumulated from the red, green, and blue pixel data of the most significant grayscale level to the red, green, and blue pixel data of the least significant grayscale level, the reference accumulation value being set to the red, green, and blue pixel data number corresponding to a range of 1~5% of total red, green, and blue pixel data included in each of the block image data.

8. The liquid crystal display device claimed as claim 1, wherein the backlight unit is driven by the first dimming signal in a color dimming mode.

9. The liquid crystal display device claimed as claim 1, wherein the backlight unit is driven by the second dimming signal in a brightness dimming mode.

10. The method claimed as claim 7, wherein the backlight unit is driven by the first dimming signal in a color dimming mode.

11. The method claimed as claim 7, wherein the backlight unit is driven by the second dimming signal in a brightness dimming mode.

* * * * *